US009088063B1

(12) United States Patent
Podell et al.

(10) Patent No.: US 9,088,063 B1
(45) Date of Patent: Jul. 21, 2015

(54) HYBRID COUPLER

(71) Applicant: Werlatone, Inc., Brewster, NY (US)

(72) Inventors: Allen F. Podell, Palo Alto, CA (US); Harishankar Nagarajan, Fishkill, NY (US)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 14/645,267

(22) Filed: Mar. 11, 2015

(51) Int. Cl.
*H01P 5/22* (2006.01)

(52) U.S. Cl.
CPC ..... *H01P 5/22* (2013.01)

(58) Field of Classification Search
CPC ..... H01P 5/22; H01P 5/222
USPC ..... 333/117, 120
See application file for complete search history.

(56) References Cited

U.S. PATENT DOCUMENTS

| | | | |
|---|---|---|---|
| 2,244,756 | A | 6/1941 | Alford |
| 2,666,132 | A | 1/1954 | Barrow |
| 3,239,781 | A | 3/1966 | Podell |
| 3,311,850 | A | 3/1967 | Podell |
| 3,484,724 | A | 12/1969 | Podell |
| 3,508,171 | A | 4/1970 | Podell |
| 3,516,025 | A | 6/1970 | Podell |
| 3,629,733 | A | 12/1971 | Podell |
| 3,980,972 | A | 9/1976 | Podell et al. |
| 4,011,528 | A | 3/1977 | Podell et al. |
| 4,023,123 | A | 5/1977 | Reindel |
| 4,800,345 | A | 1/1989 | Podell et al. |
| 4,937,541 | A | 6/1990 | Podell et al. |
| 5,889,444 | A | 3/1999 | Johnson et al. |
| 5,926,076 | A | 7/1999 | Johnson et al. |
| 6,871,056 | B2 | 3/2005 | Cho et al. |
| 6,972,639 | B2 | 12/2005 | Podell |
| 7,042,309 | B2 | 5/2006 | Podell |
| 7,132,906 | B2 | 11/2006 | Podell |
| 7,138,887 | B2 | 11/2006 | Podell |
| 7,190,240 | B2 | 3/2007 | Podell |
| 7,245,192 | B2 | 7/2007 | Podell |
| 7,345,557 | B2 | 3/2008 | Podell |

OTHER PUBLICATIONS

CPW Reverse-Phase Hybrid-Ring Coupler image, Retrieved from the Internet on Jun. 20, 2014, URL: http://www.qsl.net/va3iul/Homebrew_RF_Circuit_Design_Ideas/CPW_Reverse-Phase_Hybrid-Ring_Coupler.gif, 1 page

*Primary Examiner* — Benny Lee
*Assistant Examiner* — Rakesh Patel
(74) *Attorney, Agent, or Firm* — Kolisch Hartwell, P.C.

(57) ABSTRACT

A hybrid coupler may include first, second, third, and fourth ports, and first, second, third, fourth, fifth, sixth, seventh, and eighth transmission lines. Each of the transmission lines may include a signal conductor inductively coupled to a signal-return conductor. The first, second, third, and fourth transmission lines may be connected together to form a loop with the first, second, and third transmission lines in series and the fourth transmission line twisted. The fifth, sixth, seventh, and eighth transmission lines may respectively connect respective junctions of the loop to the first, second, third, and fourth ports. A junction of the signal-return conductors of the first, fourth, and fifth transmission lines may not be directly connected to ground. Similarly, a junction of the signal conductor of the fourth transmission line and the signal-return conductors of the third and eighth transmission lines may not be directly connected to ground.

19 Claims, 7 Drawing Sheets

HYBRID COUPLER

BACKGROUND

A pair of conductive lines are coupled when they are spaced apart, but spaced closely enough together for energy flowing in one to be induced in the other. The amount of energy flowing between the lines is related to the dielectric medium the conductors are in and the spacing between the lines. Even though electromagnetic fields surrounding the lines are theoretically infinite, lines are often referred to as being closely or tightly coupled, loosely coupled, or uncoupled, based on the relative amount of coupling. The amount of coupling may be defined by a coupling coefficient. However, as a practical measure, two lines may be considered to be inductively coupled when a detectable signal is coupled from one line onto the other. A threshold of coupling may be appropriate to distinguish between coupled and uncoupled lines. In most applications, two lines that have less than 20 dB inductive coupling between them are considered to be uncoupled lines. In some applications, lines that have less than 100 dB are considered to be uncoupled lines. In terms of a coupling coefficient, two lines may be considered to be closely coupled if the coupling coefficient is 0.1 or greater. Thus, two lines may be considered as loosely coupled or substantially uncoupled if they have a coupling coefficient of less than 0.1.

Couplers are electromagnetic devices formed to take advantage of coupled lines, and may have four ports, one associated with each end of two coupled lines. A main line has an input connected directly or indirectly to an input port. The other end is connected to the direct port. The other or auxiliary line extends between a coupled port and an isolated port. A coupler may be reversed, in which case the isolated port becomes the input port and the input port becomes the isolated port. Similarly, the coupled port and direct port have reversed designations.

A hybrid coupler is generally assumed to divide its output power equally between the two outputs. One type of hybrid coupler is referred to as a ring-hybrid coupler, such as the hybrid coupler disclosed in U.S. Pat. No. 3,516,025. This device is a four port hybrid formed of two pairs of ports such that the opposite ports of a pair are isolated from one another and each port is closely coupled to the ports of the other pair. This hybrid coupler includes three equal length sections of transmission line with terminating loads connected across both ends of each of the transmission lines. One conductor of each of the transmission lines is also connected at both ends to ground. A fourth equal length section of transmission line connects the free ends of two of the transmission lines with the connections at one end of this fourth transmission line being reversed. The lengths of each of the transmission lines are selected to be one quarter of a wavelength for the center frequency of the bandwidth over which the hybrid is to operate.

Such a conventional ring-hybrid may include in series with each terminating load a transmission line of length equal to the length of the transmission lines in the ring and of a selected characteristic impedance. This quarter wavelength line is left open at the unconnected end. The limitations of bandwidth experienced in the ring-hybrid arise at frequencies below the center frequency because of an inherently inductive characteristic, whereas the limitations in bandwidth at frequencies above the center frequency arise, because at these frequencies, the network appears inherently capacitive. The open quarter wavelength sections tend to compensate for this effect since at increased frequencies they appear inductive and at decreased frequencies they appear capacitive. The network can be further compensated by including in series with each terminating load a quarter wavelength open ended section of transmission line and also in shunt with each load a quarter wavelength shorted end section of transmission line.

SUMMARY

A hybrid coupler may include first, second, third, and fourth ports, and first, second, third, fourth, fifth, sixth, seventh, and eighth transmission lines. The first, second, third, fourth, fifth, sixth, seventh, and eighth transmission lines may include respective first, second, third, fourth, fifth, sixth, seventh, and eighth signal conductors, and respective first, second, third, fourth, fifth, sixth, seventh, and eighth signal-return conductors. Each of the signal conductors and signal-return conductors may have respective first and second ends.

The first, second, third, and fourth transmission lines may be connected together to form a loop with the first, second, and third transmission lines connected in series. The first end of the first signal conductor may be connected to the second end of the second signal conductor at a first junction. The first end of the first signal-return conductor may be connected to the second end of the second signal-return conductor at a second junction. The first end of the second signal conductor may be connected to the second end of the third signal conductor at a third junction. The first end of the second signal-return conductor may be connected to the second end of the third signal-return conductor at a fourth junction. The first end of the third signal conductor may be connected to the second end of the fourth signal-return conductor at a fifth junction. The first end of the third signal-return conductor may be connected to the second end of the fourth signal conductor at a sixth junction. The first end of the fourth signal conductor may be connected to the second end of the first signal conductor at a seventh junction. The first end of the fourth signal-return conductor may be connected to the second end of the first signal-return conductor at an eighth junction.

The fifth, sixth, seventh, and eighth transmission lines may respectively connect the loop to the first, second, third, and fourth ports. For example, the fifth signal and signal-return conductors may connect the respective seventh and eighth junctions to the first port. The sixth signal and signal-return conductors may connect the respective first and second junctions to the second port. The seventh signal and signal-return conductors may connect the respective third and fourth junctions to the third port. The eighth signal and signal-return conductors may connect the respective fifth and sixth junctions to the fourth port.

Further, the second and fourth junctions may be connected to ground, and the sixth and eighth junctions may not be directly connected to ground. The first signal-return conductor may be connected to ground at a first position disposed between and spaced from the first and second ends of the first signal-return conductor. The third signal-return conductor may be connected to ground at a second position disposed between and spaced from the first and second ends of the third signal-return conductor.

DETAILED DESCRIPTION OF VARIOUS EMBODIMENTS

Figure 1:
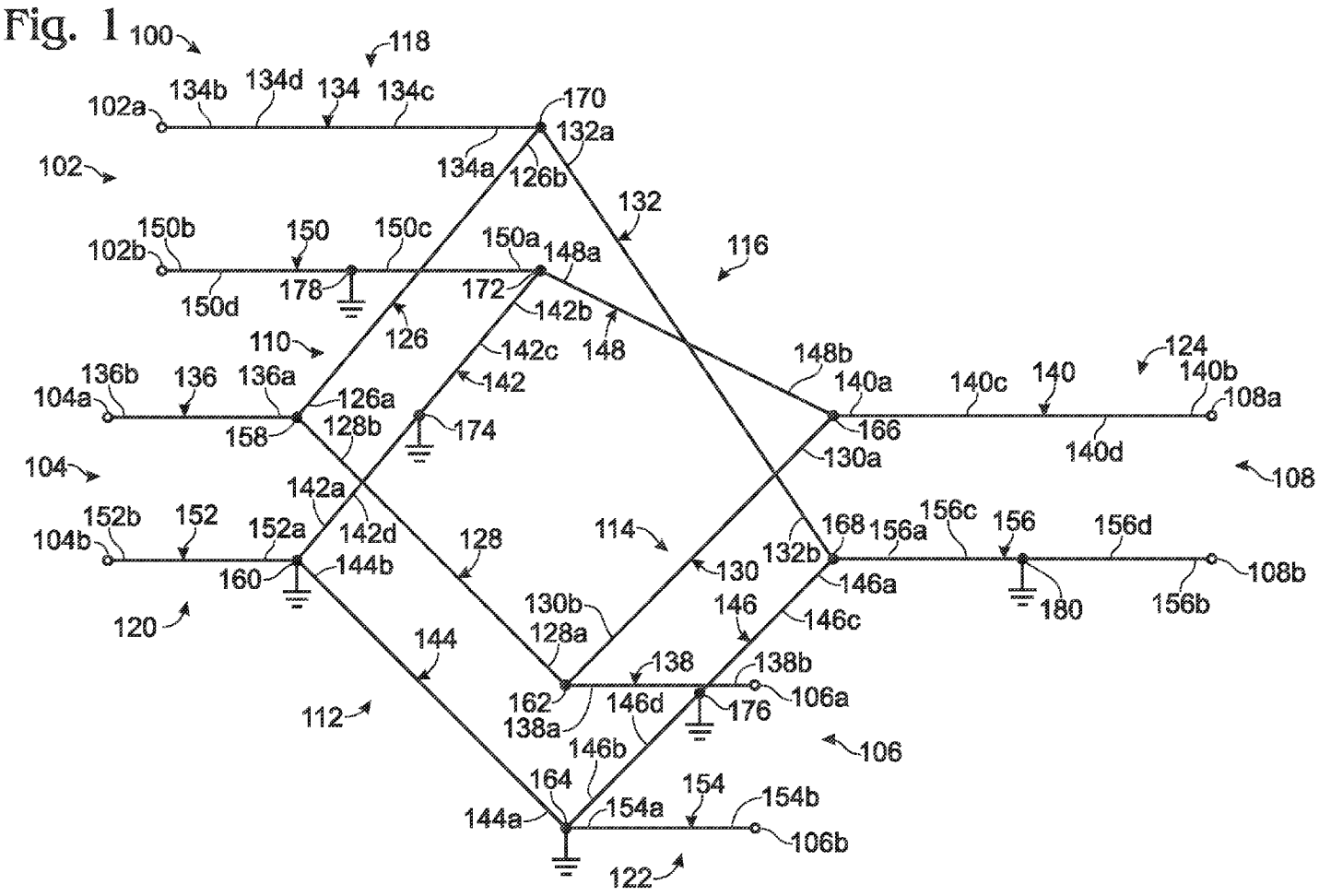
FIG. 1 is a schematic diagram of an example of a hybrid coupler.

FIG. 1 depicts a ring-type hybrid coupler 100. Coupler 100 may include first, second, third, and fourth ports 102, 104, 106, 108, and first, second, third, fourth, fifth, sixth, seventh, and eighth transmission lines 110, 112, 114, 116, 118, 120, 122, 124. Transmission lines 110, 112, 114, 116, 118, 124 may each have an electrical length of $\lambda/4$, and transmission lines 120, 122 may each have an electrical length of $\lambda/8$, where $\lambda$ is a wavelength of an operating frequency of the hybrid coupler.

As will be described below in further detail, in this example respective junctions of signal-return conductors of respective transmission lines 110, 118 and 114, 124 may not be directly connected to ground. Rather, the associated signal-return conductors of these transmission lines may be grounded at respective positions spaced away from the respective junctions. Such a configuration may provide for improved operation of coupler 100, as compared to pre-existing ring-type hybrid couplers. For example, pre-existing ring-type hybrid couplers typically do not perform well over more than an octave of input frequencies. Previous attempts have been made to increase this operational bandwidth, for example, by coiling up a reversing line of the hybrid coupler around ferrite to increase inductance. However, such coiling typically reduces thermal capability of the reversing line. In contrast, coupler 100 may be structured to perform over a bandwidth of three-to-one without such coiling, aspects of which are described below in greater detail.

In particular, transmission lines 110, 112, 114, 116, 118, 120, 122, 124 may include respective first, second, third, fourth, fifth, sixth, seventh, and eighth signal conductors 126, 128, 130, 132, 134, 136, 138, 140. Further, transmission lines 110, 112, 114, 116, 118, 120, 122, 124 may include respective first, second, third, fourth, fifth, sixth, seventh, and eighth signal-return conductors 142, 144, 146, 148, 150, 152, 154, 156.

Signal-return conductors 142, 144, 146, 148, 150, 152, 154, 156 may be closely inductively coupled to respective signal conductors 126, 128, 130, 132, 134, 136, 138, 140. In particular, conductors 126, 142 may be closely mutually inductively coupled to one another, conductors 128, 144 may be closely mutually inductively coupled to one another, and so on, as is generally the case with associated signal and signal-return conductors of a particular transmission line.

Each of the signal conductors and signal return conductors may have first and second ends. In particular, conductor 126 may have first and second ends 126*a*, 126*b*. Conductor 128 may have first and second ends 128*a*, 128*b*. Conductor 130 may have first and second ends 130*a*, 130*b*. Conductor 132 may have first and second ends 132*a*, 132*b*. Conductor 134 may have first and second ends 134*a*, 134*b*. Conductor 136 may have first and second ends 136*a*, 136*b*. Conductor 138 may have first and second ends 138*a*, 138*b*. Conductor 140 may have first and second ends 140*a*, 140*b*. Conductor 142 may have first and second ends 142*a*, 142*b*. Conductor 144 may have first and second ends 144*a*, 144*b*. Conductor 146 may have first and second ends 146*a*, 146*b*. Conductor 148 may have first and second ends 148*a*, 148*b*. Conductor 150 may have first and second ends 150*a*, 150*b*. Conductor 152 may have first and second ends 152*a*, 152*b*. Conductor 154 may have first and second ends 154*a*, 154*b*. Conductor 156 may have first and second ends 156*a*, 156*b*.

As shown, transmission lines 110, 112, 114, 116 may be connected together to form a loop with transmission lines 110, 112, 114 in series and transmission line 116 twisted (or reversed, or being a reversing line). For example, the loop may be characterized by the following connections (e.g., electrical connections) at the following junctions. End 126*a* may be connected to end 128*b* at a first junction 158. End 142*a* may be connected to end 144*b* at a second junction 160. End 128*a* may be connected to end 130*b* at a third junction 162. End 144*a* may be connected to end 146*b* at a fourth junction 164. End 130*a* may be connected to end 148*b* at a fifth junction 166. End 146*a* may be connected to end 132*b* at a sixth junction 168. End 132*a* may be connected to end 126*b* at a seventh junction 170. End 148*a* may be connected to end 142*b* at an eighth junction 172.

As also shown, transmission lines 118, 120, 122, 124 may respectively connect the loop to ports 102, 104, 106, 108 by the respective conductors connecting (e.g., electrically connecting) the respective junctions to the respective ports. For example conductors 134, 150 may connect respective junctions 170, 172 to port 102. Conductors 136, 152 may connect respective junctions 158, 160 to port 104. Conductors 138, 154 may connect respective junctions 162, 164 to port 106, and conductors 140, 156 may connect respective junctions 166, 168 to port 108.

More specifically, conductor 134 of line 118 may connect junction 170 to a first node 102*a* of port 102. Conductor 150 of line 118 may connect junction 172 to a second node 102*b* of port 102. Conductor 136 of line 120 may connect junction 158 to a first node 104*a* of port 104. Conductor 152 of line 120 may connect junction 160 to a second node 104*b* of port 104. Conductor 138 of line 122 may connect junction 162 to a first node 106*a* of port 106. Conductor 154 of line 122 may connect junction 164 to a second node 106*b* of port 106. Conductor 140 of line 124 may connect junction 166 to a first node 108*a* of port 108. Conductor 156 of line 124 may connect junction 168 to a second node 108*b* of port 108.

Junctions 160, 164 may be connected (e.g., directly connected) to ground, and junctions 168, 172 may not be directly connected to ground. Rather, conductors 142, 146, 150, 156 may be connected to ground at respective first, second, third, and fourth positions 174, 176, 178, 180, there being no connections to ground along conductors 132, 148.

More specifically, conductor 142 may be directly connected to ground at position 174. Position 174 may be disposed between and spaced apart from first and second ends 142*a*, 142*b* of conductor 142. For example, conductor 142 may include first and second portions 142*c*, 142*d*. Portions 142*c*, 142*d* may each have an electrical length of less than $\lambda/4$. In particular, portion 142*c* may have an electrical length of $\lambda/8$ extending from junction 172 to position 174, there being no other connections to ground in portion 142*c*. Similarly, portion 142*d* may have an electrical length of $\lambda/8$ extending from position 174 to junction 160. Accordingly, junctions 160, 172 may be disposed approximately $\lambda/8$ away from position 174.

In a similar configuration, conductor 146 may be directly connected to ground at position 176, which may be disposed between and spaced apart from first and second ends 146*a*, 146*b* of conductor 146. For example, conductor 146 may include first and second portions 146*c*, 146*d*. Portions 146*c*, 146*d* may each have an electrical length of less than λ/4. In particular, portion 146*c* may have an electrical length of λ/8 extending from junction 168 to position 176, there being no other connections to ground in portion 146*c*. Also, portion 146*d* may have an electrical length of λ/8 extending from position 176 to junction 164. Stated another way, junctions 164, 168 may be disposed approximately λ/8 away from position 176.

Conductor 150 may be first connected to ground relative to junction 172 at position 178 spaced from junction 172. For example, conductor 150 may be not directly connected to ground between position 178 and junction 172. In particular, position 178 may be spaced λ/8 away from junction 172.

More specifically, conductors 134, 150 may include respective first portions 134*c*, 150*c* and second portions 134*d*, 150*d*. Each of portions 134*c*, 134*d*, 150*c*, 150*d* may have an electrical length less than λ/4. In particular, portion 150*c* of conductor 150 may have an electrical length of λ/8 extending from junction 172 to position 178. Portion 150*d* of conductor 150 may have an electrical length of λ/8 extending from position 178 to node 102*b*. Similarly, portion 134*c* of conductor 134 may have an electrical length of λ/8 extending from junction 170 to a position approximately centrally disposed between first and second ends 134*a*, 134*b* of conductor 134 and aligned with position 178. Similarly, portion 134*d* of conductor 134 may have an electrical length of λ/8 extending from node 102*a* to the position that is approximately centrally disposed between ends 134*a*, 134*b*.

In a similar configuration, conductor 156 may be first connected to ground relative to junction 168 at position 180 spaced from junction 168. For example, conductor 156 may be not directly connected to ground between position 180 and junction 168. In particular, position 180 may be spaced λ/8 away from junction 168.

More specifically, conductors 140, 156 may include respective first portions 140*c*, 156*c* and second portions 140*d*, 156*d*. Each of portions 140*c*, 140*d*, 156*c*, 156*d* may have an electrical length less than λ/4. In particular, portion 156*c* of conductor 156 may have an electrical length of λ/8 extending from junction 168 to position 180. Portion 156*d* of conductor 156 may have an electrical length of λ/8 extending from position 180 to node 108*b*. Similarly, portion 140*c* of conductor 140 may have an electrical length of λ/8 extending from junction 166 to a position approximately centrally disposed between first and second ends 140*a*, 140*b* of conductor 140 and aligned with position 180. Similarly, portion 140*d* of conductor 140 may have an electrical length of λ/8 extending from node 108*a* to the position that is approximately centrally disposed between ends 140*a*, 140*b*.

Figure 2:
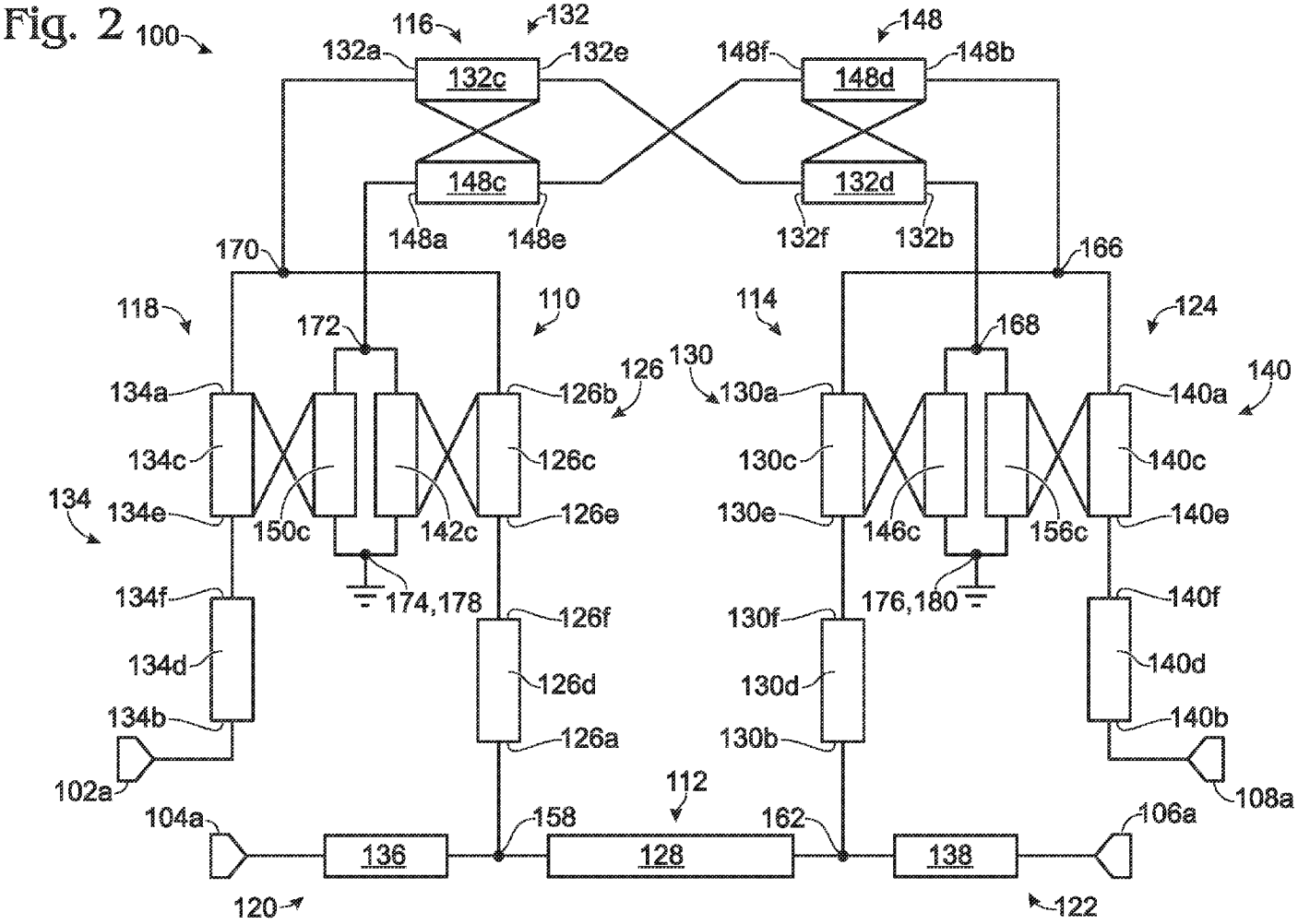
FIG. 2 is a schematic diagram used for simulating the hybrid coupler of FIG. 1.

FIG. 2 depicts a schematic diagram of hybrid coupler 100, which may be used for simulation purposes. For convenience, the reference numbers used in FIG. 1 are applied to corresponding features shown in FIG. 2. In FIG. 2, all of the conductors (or line sections) may have an electrical length of λ/8, except for section 128, which may have an electrical length of λ/4. It should be noted that various components are not explicitly depicted in FIG. 2, such as second nodes 102*b*, 104*b*, 106*b*, 108*b*, signal-return conductors 152, 144, 154, and conductor portions 142*d*, 146*d*, 150*d*, 156*d*. However, these components may still be functionally included and factored into a simulation by modeling associated signal conductors and nodes as respective transmission lines and ports with respect to a reference voltage.

Further, as can be seen, some of the conductors depicted in FIG. 1 are depicted in FIG. 2 as having first and second portions. For example, conductor 126 may include first and second portions 126*c*, 126*d*. Conductor 130 may include first and second portions 130*c*, 130*d*. Conductor 132 may include first and second portions 132*c*, 132*d*. Conductor 148 may include first and second portions 148*c*, 148*d*.

More specifically, portions 126*c*, 126*d* may have respective first ends 126*e*, 126*f* that are connected to one another. Portions 126*c*, 126*d* may further have respective second ends 126*b*, 126*a*. Portions 130*c*, 130*d* may have respective first ends 130*e*, 130*f* that are connected to one another. Portions 130*c*, 130*d* may further have respective second ends 130*a*, 130*b*. Portions 132*c*, 132*d* may have respective first ends 132*e*, 132*f* that are connected to one another. Portions 132*c*, 132*d* may further have respective second ends that are formed by respective ends 132*a*, 132*b*. Portions 134*c*, 134*d* may have respective first ends 134*e*, 134*f* that are connected to one another. Portions 134*c*, 134*d* may further have respective second ends 134*a*, 134*b*. Portions 140*c*, 140*d* may have respective first ends 140*e*, 140*f* that are connected to one another. Portions 140*c*, 140*d* may further have respective second ends 140*a*, 140*b*. Portions 148*c*, 148*d* may have respective first ends 148*e*, 148*f* that are connected to one another. Portions 148*c*, 148*d* may further have respective second ends 148*a*, 148*b*.

As is mentioned above and also illustrated in FIG. 2, particular signal conductor portions may be closely inductively coupled to particular associated signal-return conductor portions. For example, portions 134*c*, 150*c* may be closely mutually inductively coupled. Portions 126*c*, 142*c* may be closely mutually inductively coupled. Portions 132*c*, 148*c* may be closely mutually inductively coupled. Portions 132*d*, 148*d* may be closely mutually inductively coupled. Portions 130*c*, 146*c* may be closely mutually inductively coupled. Portions 140*c*, 156*c* may be closely mutually inductively coupled.

Portions 134*d*, 140*d* (or associated transmission line sections) may be configured for broadband matching, which may contribute to the three-to-one operational bandwidth of coupler 100 in combination with ungrounded junctions 168, 172. For example, sections 134*d*, 140*d* may each have an electrical length of λ/8 (as previously described), which, in conjunction with the coupled sections of respective transmission lines 118, 124, may add λ/4 broadband matching, thus stretching the bandwidth of coupler 100 from an octave to three-to-one.

Figure 3:
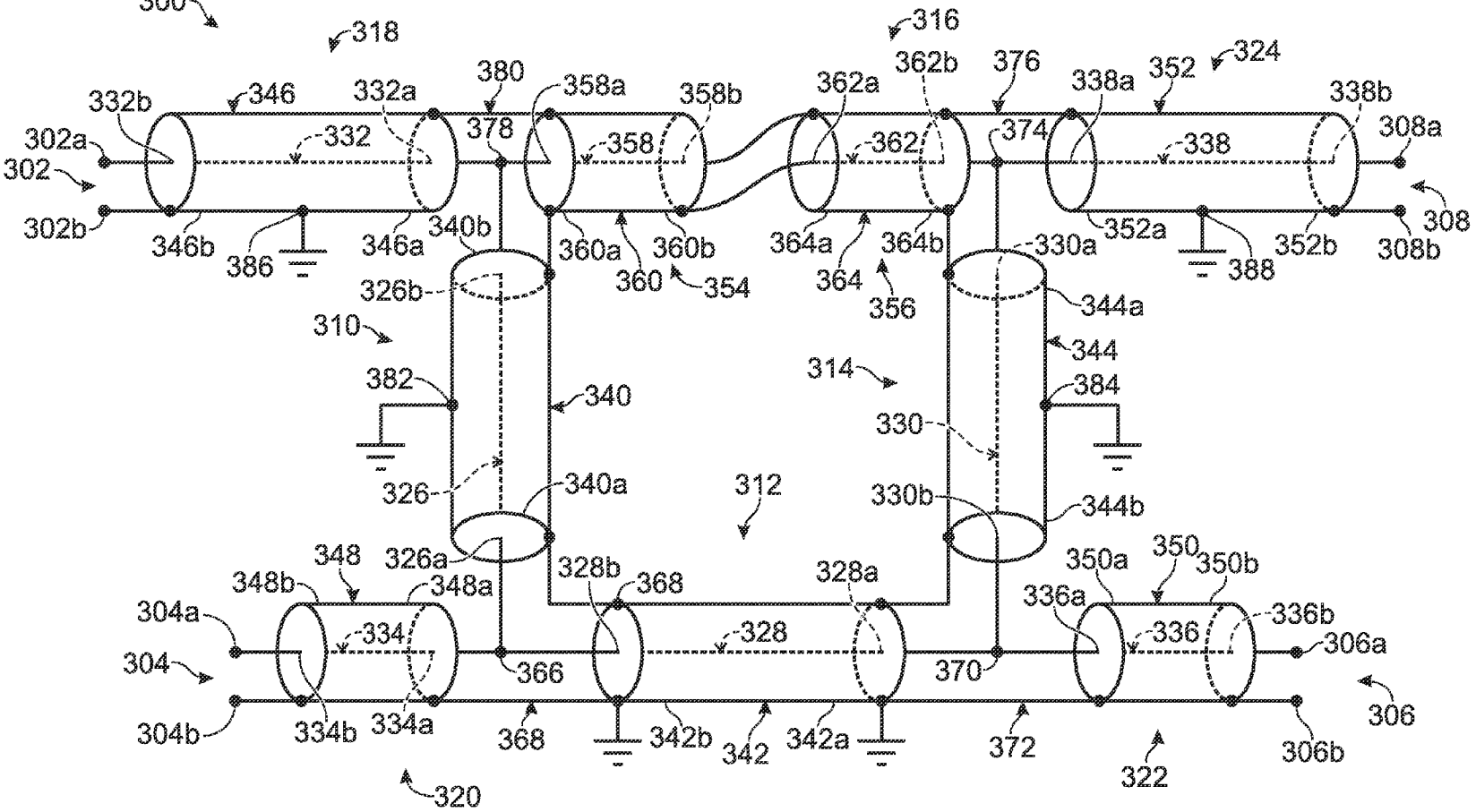
FIG. 3 is a schematic diagram of a coaxial transmission line embodiment of the hybrid coupler of FIG. 1.

FIG. 3 depicts a hybrid coupler 300, which is an embodiment of coupler 100. For example, coupler 300 may include first, second, third, and fourth ports 302, 304, 306, 308, and first, second, third, fourth, fifth, sixth, seventh, and eighth coaxial transmission lines 310, 312, 314, 316, 318, 320, 322, 324. Lines 310, 312, 314, 316, 318, 324 may each have an electrical length of λ/4, and lines 320, 22 may each have an electrical length of λ/8, where λ is a wavelength of an operating frequency of coupler 300.

Lines 310, 312, 314, 318, 320, 322, 324 may include respective inner or center conductors 326, 328, 330, 332, 334, 336, 338, which may be signal conductors of the respective coaxial transmission lines. Lines 310, 312, 314, 318, 320, 322, 324 may also include respective outer or shield conductors 340, 342, 344, 346, 348, 350, 352, which may be signal-return conductors of the respective coaxial transmission lines. As shown, conductors 326, 328, 330, 332, 334, 336, 338, 340, 342, 344, 346, 348, 350, 352 may have respective first ends 326*a*, 328*a*, 330*a*, 332*a*, 334*a*, 336*a*, 338*a*, 340*a*, 342*a*, 344*a*, 346*a*, 348*a*, 350*a*, 352*a* and second ends 326*b*, 328*b*, 330*b*, 332*b*, 334*b*, 336*b*, 338*b*, 340*b*, 342*b*, 344*b*, 346*b*, 348*b*, 350*b*, 352*b*.

Line 316 may include first and second coaxial transmission line portions 354, 356. Portion 354 may include a first inner conductor portion 358 and a first outer conductor portion 360. Similarly, portion 356 may include a second inner conductor portion 362 and a second outer conductor portion 364. Conductor portions 358, 360, 362, 364 may have respective first ends 358*a*, 360*a*, 362*a*, 364*a* and second ends 358*b*, 360*b*, 362*b*, 364*b*. Similar to lines 320, 322, conductor portions 358, 360, 362, 364 may each have an electrical length of λ/8.

Lines 310, 312, 314, 316 may be connected together to form a loop with transmission lines 310, 312, 314 connected in series and transmission line 316 twisted (or forming a reversing line). For example, the loop may be characterized by the following connections at the following junctions. In a connection of line 310 to line 312, end 326*a* may be connected to end 328*b* at a first junction 366, and end 340*a* may be connected to end 342*b* at a second junction 368. In a connection of line 312 to line 314, end 328*a* may be connected to end 330*b* at a third junction 370, and end 342*a* may be connected to end 344*b* at a fourth junction 372. In a connection of line 314 to line 316, end 330*a* may be connected to end 362*b* at a fifth junction 374, and end 344*a* may be connected to end 364*b* at a sixth junction 376. To form line 316, end 362*a* may be connected to end 360*b*, and end 364*a* may be connected to end 358*b*. In a connection of line 316 to line 310, end 358*a* may be connected to end 326*b* at a seventh junction 378, and end 360*a* may be connected to end 340*b* at an eighth junction 380.

Lines 318, 320, 322, 324 may respectively connect the loop to ports 302, 304, 306, 308. In particular, conductors 332, 346 may connect respective junctions 378, 380 to port 302. Conductors 334, 348 may connect respective junctions 366, 368 to port 304. Conductors 336, 350 may connect respective junctions 370, 372 to port 306. Conductors 338, 352 may connect respective junctions 374, 376 to port 308.

More specifically, end 332*a* may be connected to junction 378, and end 332*b* may be connected to a first node 302*a* of port 302. End 346*a* may be connected to junction 380, and end 346*b* may be connected to a second node 302*b* of port 302. End 334*a* may be connected to junction 366, and end 334*b* may be connected to a first node 304*a* of port 304. End 348*a* may be connected to junction 368, and end 348*b* may be connected to a second node 304*b* of port 304. End 336*a* may be connected to junction 370, and end 336*b* may be connected to a first node 306*a* of port 306. End 350*a* may be connected to junction 372, and end 350*b* may be connected to a second node 306*b* of port 306. End 338*a* may be connected to junction 374, and end 338*b* may be connected to a first node 308*a* of port 308. End 352*a* may be connected to junction 376, and end 352*b* may be connected to a second node 308*b* of port 308.

As shown, junctions 368, 372 may be connected (e.g., directly) to ground, and junctions 376, 380 may not be directly connected to ground, there being no connections to ground along conductors 360, 364. Conductor 340 may be first connected to ground relative to junction 380 at a first position 382 disposed between and spaced apart from ends 340*a*, 340*b*, and conductor 344 may be first connected to ground relative to junction 380 at a second position 384 disposed between and spaced apart from ends 344*a*, 344*b*. Conductor 346 may be first connected to ground relative to junction 380 at a third position 386 spaced apart from junction 380. Similarly, conductor 352 may be first connected to ground relative to junction 376 at a fourth position 388 spaced apart from junction 376.

In some embodiments, conductor 340 may have an electrical length of λ/8 extending from position 382 to junction 380, and an electrical length of λ/8 extending from position 382 to junction 368. Conductor 346 may have an electrical length of λ/8 extending from junction 380 to position 386, and an electrical length of λ/8 extending from position 386 to node 302*b*. Similarly, conductor 344 may have an electrical length of λ/8 extending from position 384 to junction 376, and an electrical length of λ/8 extending from position 384 to junction 372. Conductor 352 may have an electrical length of λ/8 extending from junction 376 to position 388, and an electrical length of λ/8 extending from position 388 to node 308*b*.

As can be seen particularly with reference to FIGS. 1 and 3, lines 310, 312, 314 may respectively include embodiments of first, second, and third signal conductors 126, 128, 130 as respective first, second, and third inner conductors (or center conductors) 326, 328, 330, and embodiments of first, second, and third signal-return conductors 142, 144, 146 as respective first, second, and third outer conductors (or shield conductors) 340, 342, 344. Further, inner conductor portion 358 and outer conductor portion 364 may form an embodiment of fourth signal conductor 132, and outer conductor portion 360 and inner conductor portion 362 may form an embodiment of fourth signal-return conductor 148.

Figure 4A:
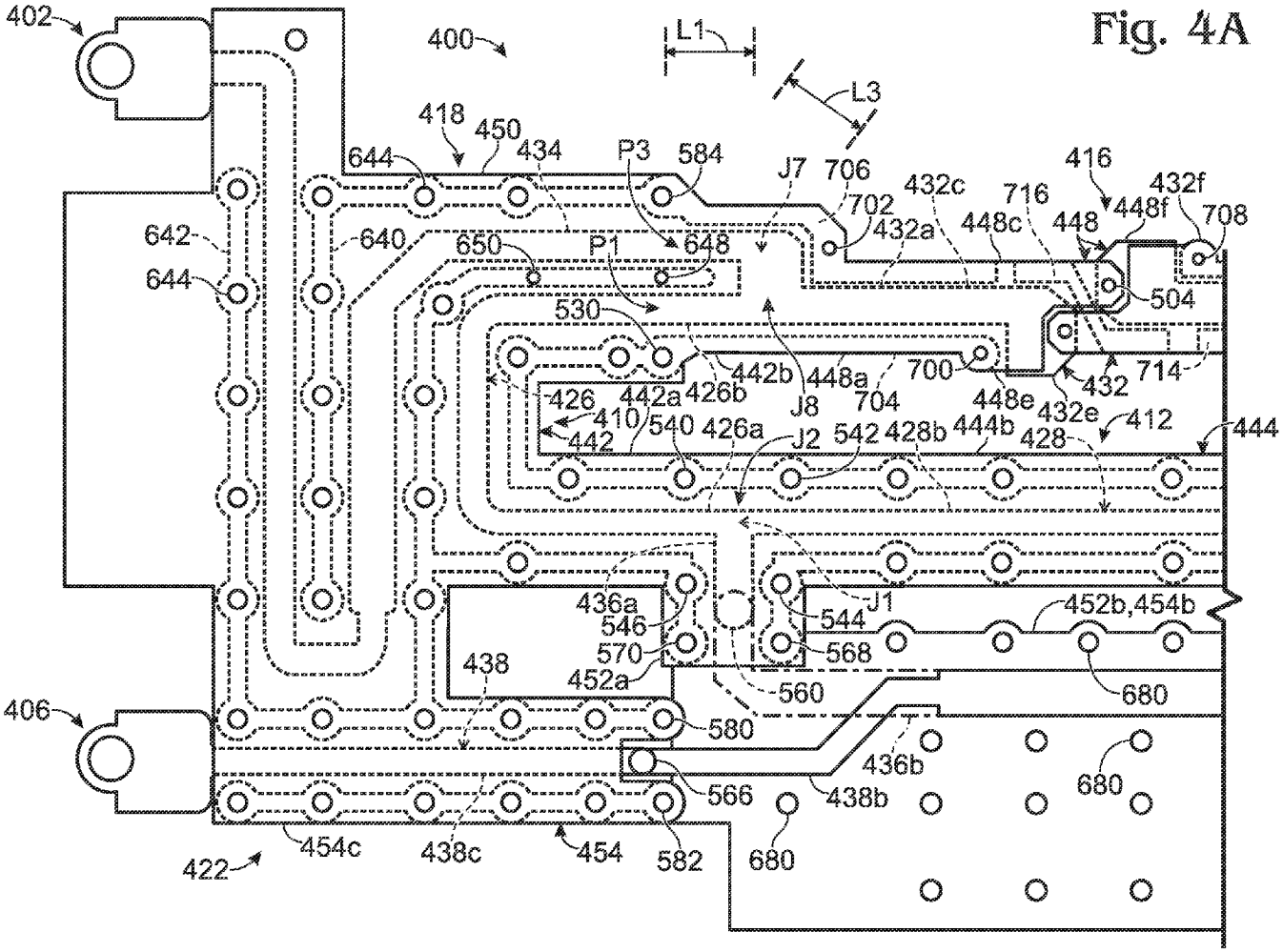
FIGS. 4A and 4B when viewed together, and as such will hereinafter be collectively referred to as FIG. 4, depict a planar embodiment of the hybrid coupler of FIG. 1, with ground plane layers removed to simplify illustration.
Figure 4B:
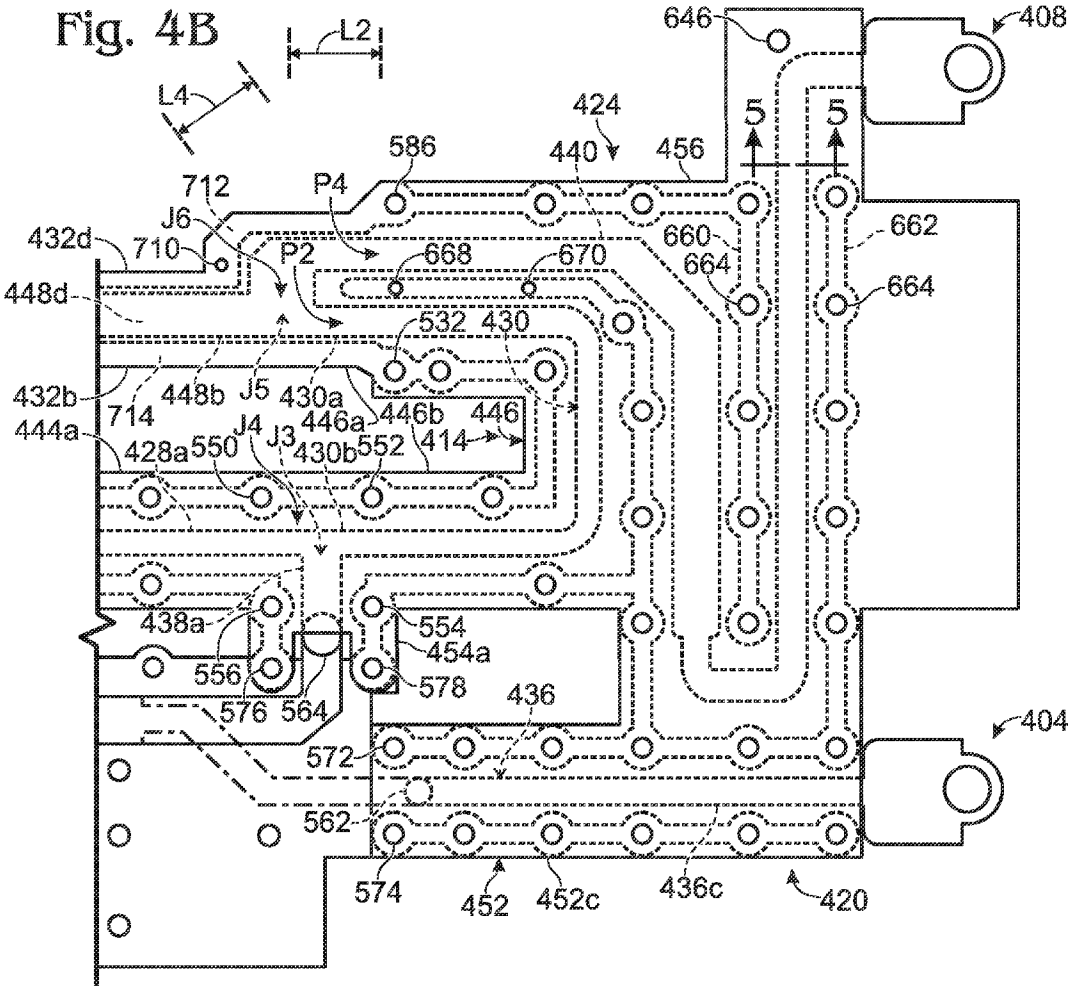
Figure 5:
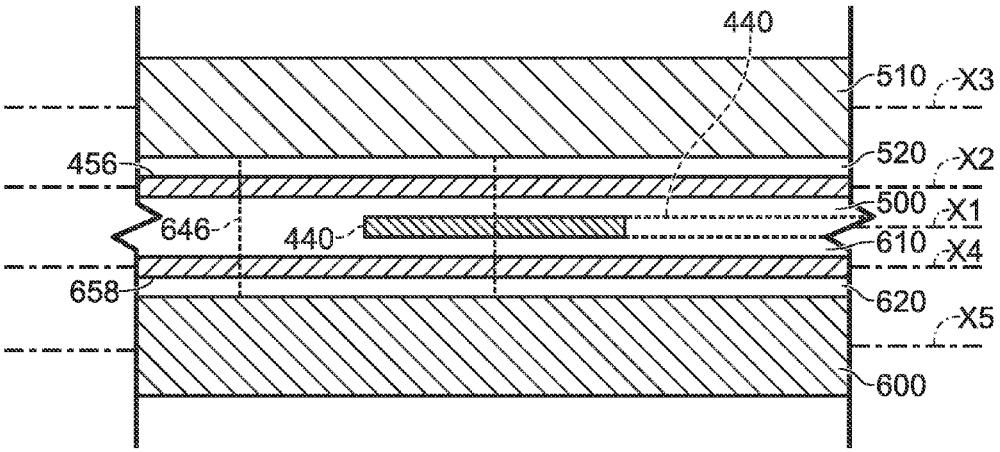
FIG. 5 is a cross-section of the planar embodiment taken along line 5-5 in FIG. 4.

FIGS. 4 and 5 depict a planar hybrid coupler 400. In particular, FIG. 4 is a plan view of coupler 400, and FIG. 5 is schematic cross-section of coupler 400 taken along line 5-5 in FIG. 4 to show various layers of coupler 400. As shown, coupler 400 may include first, second, third, and fourth ports 402, 404, 406, 408, and first, second, third, fourth, fifth, sixth, seventh, and eighth transmission lines 410, 412, 414, 416, 418, 420, 422, 424.

Similar to the other couplers described above, in this example, respective junctions of signal-return conductors of respective transmission lines 410, 418 and 414, 424 may not be directly connected to ground. Rather, the associated signal-return conductors of these transmission lines may be grounded at respective positions spaced away from the respective junctions, which will be described in greater detail further below.

In particular, transmission lines 410, 412, 414, 416, 418, 420, 422, 424 may include respective first, second, third, fourth, fifth, sixth, seventh, and eighth signal conductors 426, 428, 430, 432, 434, 436, 438, 440. Further, transmission lines 410, 412, 414, 416, 418, 420, 422, 424 may include respective first, second, third, fourth, fifth, sixth, seventh, and eighth signal-return conductors 442, 444, 446, 448, 450, 452, 454, 456, which may be closely inductively coupled to the respective signal conductors.

As shown, transmission lines 410, 412, 414, 416, 418, 420, 422, 424 may be planar transmission lines. In this example, these transmission lines are striplines, and as such, may each include an additional signal-return conductor disposed opposite the aforementioned respective signal-return conductor with respect to the respective signal conductor, which will also be described in greater detail further below.

Each of the signal conductors and signal-return conductor may have respective first and second ends. In FIG. 4, first ends of signal conductors and signal-return conductors are given the designation "a", and second ends of signal conductors and signal-return conductors are given the designation "b". For example, the first end of signal conductor 426 is designated with reference numeral 426*a*, and the second end of signal conductor 426 is designated with reference numeral 426*b*.

Similar to the first, second, third, and fourth transmission lines of coupler 100, transmission lines 410, 412, 414, 416 may be connected together to form a loop with transmission lines 410, 412, 414 in series. In particular, first end 426*a* of signal conductor 426 may be connected to second end 428*b* of signal conductor 428 at a first junction J1. First end 442*a* of signal-return conductor 442 may be connected to second end

444*b* of signal-return conductor 444 at a second junction J2. First end 428*a* of signal conductor 428 may be connected to second end 430*b* of signal conductor 430 at a third junction J3. First end 444*a* of signal-return conductor 444 may be connected to second end 446*b* of signal-return conductor 446 at a fourth junction J4. First end 430*a* of signal conductor 430 may be connected to second end 448*b* of signal-return conductor 448 at a fifth junction J5. First end 446*a* of signal-return conductor 446 may be connected to second end 432*b* of signal conductor 432 at a sixth junction J6. First end 432*a* of signal conductor 432 may be connected to second end 426*b* of signal conductor 426 at a seventh junction J7. First end 448*a* of signal-return conductor 448 may be connected to second end 442*b* of signal-return conductor 442 at an eighth junction J8.

Further, transmission lines 418, 420, 422, 424 may respectively connect the loop to ports 402, 404, 406, 408 by the respective conductors connecting (e.g., electrically connecting) the respective junctions to the respective ports. For example, conductors 434, 450 may connect respective junctions J7, J8 to port 402. Conductors 436, 452 may connect respective junctions J1, J2 to port 404. Conductors 438, 454 may connect respective junctions J3, J4 to port 406. Conductors 440, 456 may connect respective junctions J5, J6 to port 408.

Similar to the second and fourth junctions of coupler 100, second and fourth junctions J2, J4 of coupler 400 may be connected to ground. Also, junctions J6, J8 may not be directly connected to ground. For example, first signal-return conductor 442 may be first connected to ground relative to junction J8 at a first position P1. Position P1 may be disposed between and spaced from first and second ends 442*a*, 442*b* of first signal-return conductor 442. Similarly, third signal-return conductor 446 may be first connected to ground relative to junction J6 at a second position P2. Second position P2 may be disposed between and spaced from first and second ends 446*a*, 446*b* of third signal-return conductor 446.

More specifically, as described above, first, second, third, and fourth transmission lines 410, 412, 414, 416 are respective first, second, third, and fourth planar transmission lines (e.g., striplines). Planar transmission lines 410, 412, 414 may be at least partially characterized by first, second, and third signal conductors 426, 428, 430 extending along a first plane X1 (see FIG. 5), and first, second, and third signal-return conductors 442, 444, 446 extending along a second plane X2. As shown in FIG. 5, second plane X2 may be parallel to and spaced apart from first plane X1.

Fourth planar transmission line 416 may be at least partially characterized by the following conductor portions extending along the following respective planes. For example, fourth signal conductor 432 may include a first conductor portion 432*c* extending along first plane X1, and a second conductor portion 432*d* extending along second plane X2. A first end 432*a* may be (or form) a first end of first conductor portion 432*c*, and may accordingly be connected to junction J7. A second end 432*e* of first conductor portion 432*c* may be connected to a first end 432*f* of second conductor portion 432*d*. Second end 432*b* may form a second end of second conductor portion 432*d*, which may be connected to junction J6.

Similarly, fourth signal-return conductor 448 may include a third conductor portion 448*c* extending along second plane X2, and a fourth conductor portion 448*d* extending along first plane X1. In some embodiments, first and second conductor portions 432*c*, 432*d* may have equal electrical lengths of $\lambda/8$, where $\lambda$ is an operating frequency of coupler 400. Similarly, third and fourth conductor portions 448*c*, 448*d* may have equal electrical lengths of $\lambda/8$. First end 448*a* may be (or form) a first end of third conductor portion 448*c* and may be connected to junction J8. A second end 448*e* of third conductor portion 448 may be connected to a first end 448*f* of fourth conductor portion 448*d*. Second end 448*b* may be (or form) a second end of fourth conductor portion 448*d* and may be connected to junction J5.

For example, coupler 400 may include a first dielectric layer 500 (see FIG. 5), which may be disposed between first and second planes X1, X2. First and second electrically conductive vias 502, 504 (see FIG. 4) may extend through first dielectric layer 500 (e.g., and also through another dielectric layer opposite layer 500 relative to plane X1, which will be described in more detail further below). Second end 432*e* may be connected to first end 432*f* by via 502. Second end 448*e* may be connected to first end 448*f* by via 504.

As mentioned above, junctions J2, J4 may be directly connected to ground, and junctions J5, J8 may not be directly connected to ground. Rather, signal-return conductors 442 may first be grounded relative to junction J8 at position P1, and signal-return conductor 446 may first be connected to ground relative to junction J6 at position P2. In particular, coupler 400 may further include a first ground plane 510 (see FIG. 5), and a second dielectric layer 520. Ground plane 510 may extend along a third plane X3. Plane X3 may be parallel to and spaced apart from planes X1, X2 such that plane X2 extends between planes X1, X3. Dielectric layer 520 may be disposed between planes X2, X3. First signal-return conductor 442 may be electrically connected to ground plane 510 at first position P1, for example, by an electrically conductive via 530 (see FIG. 4). Similarly, third signal-return conductor 446 may be electrically connected to ground plane 510 at position P2, for example, by an electrically conductive via 532. Junction J2 may be grounded to ground plane 510, for example, by electrically conductive vias 540, 542, 544, 546. Similarly, junction J4 may be grounded to ground plane 510, for example, by electrically conductive vias 550, 552, 554, 556.

As also mentioned above, fifth, sixth, seventh, and eighth transmission lines 418, 420, 422, 424 are respective fifth, sixth, seventh, and eighth planar transmission lines. These planar transmission lines may be at least partially characterized by signal conductors 434, 436, 438, 440 extending (at least partially) along plane X1.

In particular, signal conductor 434 may extend along plane X1 from junction J7 to port 402. Signal conductor 440 may extend along plane X1 from junction J5 to port 408. Signal conductor 436 may include first, second, and third conductor portions 436*a*, 436*b*, 436*c*. Portions 436*a*, 436*c* may extend along plane X1. Portion 436*b* may extend along a fourth plane X4. Plane X4 may be parallel to and spaced from planes X1, X2, X3, and may be disposed opposite plane X2 relative to plane X1 (see FIG. 5). As can be seen in FIG. 4, a first end of portion 436*a* may be connected to junction J1. A second end of portion 436*a* may be connected to a first end of portion 436*b* by an electrically conductive via 560. A second end of portion 436*b* may be connected to a first end of portion 436*c* by an electrically conductive via 562. A second end of portion 436*c* may be connected to port 404.

Similarly, signal conductor 438 may include first, second, and third conductor portions 438*a*, 438*b*, 438*c*. Portions 438*a*, 438*c* may extend along plane X1. Portion 438*b* may extend along plane X2. A first end of portion 438*a* may be connected to junction J3. A second end of portion 438*a* may be connected to a first end of portion 438*b* by an electrically conductive via 564. A second end of portion 438*b* may be connected to a first end of portion 438*c* by an electrically conductive via 566. A second end of portion 438*c* may be connected to port 406.

Planar transmission lines 418, 420, 422, 424 may be further at least partially characterized by signal-return conductors 450, 452, 454, 456 extending (at least partially) along plane X2. For example, signal-return conductor 450 may extend along plane X2 from junction J8 to (or proximate) port 402. Signal-return conductor 456 may extend along plane X2 from junction J6 to (or proximate) port 408. Signal-return conductor 452 may include first, second, third conductor portions 452*a*, 452*b*, 452*c*. Portions 452*a*, 452*c* may extend along plane X2. Portion 452*b* may extend along plane X1. A first end of portion 452*a* may be connected to junction J2. A second end of portion 452*a* may be connected to a first end of portion 452*b* by electrically conductive vias 568, 570. A second end of portion 452*b* may be connected to a first end of portion 452*c* by electrically conductive vias 572, 574. A second end of portion 452*c* may extend to (or proximate) port 404.

Similarly, signal-return conductor 454 may include first, second, third conductor portions 454*a*, 454*b*, 454*c*. Portions 454*a*, 454*c* may extend along plane X2. Portion 454*b* may extend along plane X1. A first end of portion 454*a* may be connected to junction J4. A second end of portion 454*a* may be connected to a first end of portion 454*b* by electrically conductive vias 576, 578. A second end of portion 454*b* may be connected to a first end of portion 454*c* by electrically conductive vias 580, 582. A second end of portion 454*c* may extend to (or proximate) port 406.

Further, fifth signal-return conductor 450 may be electrically connected to ground plane 510 at a third position P3 spaced from junction J8. In particular, conductor 450 may be first connected to ground relative to junction J8 at position P3 by an electrically conductive via 584 extending between planes X1, X2. Similarly, eighth signal-return conductor 456 may be electrically connected to ground plane 510 at a fourth position P4 spaced from junction J6. In particular, conductor 456 may be first connected to ground relative to junction J6 at position P4 by an electrically conductive via 586 extending between planes X1, X2.

Transmission lines 410, 412, 414, 416 may each have an electrical length of (and/or corresponding with or to) λ/4. Transmission lines 418, 420, 422, 424 may each have an electrical length of (and/or corresponding with or to) λ/4 or an integral multiple of λ/4. Further, in some embodiments, transmission lines 420, 422 may each have an electrical length of (and/or corresponding with or to) λ/8. Transmission line 410 may have an electrical length L1 between junction J8 and position P1. Transmission line 414 may have an electrical length L2 between junction J6 and position P2. Transmission line 418 may have an electrical length L3 between junction J8 and position P3. Transmission line 424 may have an electrical length L4 between junction J6 and position P4.

More specifically, signal-return conductor 442 may have electrical length L1 between junction J8 and position P1. Signal-return conductor 446 may have electrical length L2 between junction J6 and position P2. Signal-return conductor 450 may have electrical length L3 between junction J8 and position P3. Signal-return conductor 456 may have electrical length L4 between junction J6 and position P4. In some embodiments, lengths L1, L2 may each be (or each correspond with or to) an electrical length of λ/8. Similarly, lengths L3, L4 may each be (or each correspond with or to) an electrical length of λ/8. In some embodiments, position P3 may be spaced λ/8 away from junction J8. Position P4 may be spaced λ/8 away from junction J6. Fifth signal conductor 434 may have an electrical length of (and/or corresponding to or with) an integral multiple of λ/4 extending between junction J7 and port 402. Similarly, eighth signal conductor 440 may have an electrical length of (and/or corresponding to or with) an integral multiple of λ/4 extending between junction J5 and port 408.

As mentioned above, planar transmission lines 410, 412, 414, 416, 418, 420, 422, 424 may be striplines, and accordingly may each include an additional signal-return conductor extending, for example, along plane X4. Further, coupler 400 may include a second ground plane 600 extending along a fifth plane X5 (e.g., parallel to and opposite plane X3 relative to plane X1, as can be seen in FIG. 5). Coupler 400 may also include third and fourth dielectric layers 610, 620. Layer 610 may be disposed between planes X1, X4. Layer 620 may be disposed between planes X4, X5.

More specifically, transmission line 418 may include another signal-return conductor similar to signal-return conductor 450 but extending along plane X4. Thread conductors 640, 642 may extend along opposing lateral edges of signal conductor 434 and along plane X1. A plurality of electrically conductive vias 644 may extend between planes X3, X5 (e.g., in a manner similar to electrically conductive via 646 depicted in FIG. 5) thereby electrically connecting thread conductors 640, 642, signal-return conductor 450, and the signal-return conductor of transmission line 418 in plane X4 to ground planes 510, 600. Similarly, via 584 may extend between planes X3, X5 thereby electrically connecting thread conductor 640, signal-return conductor 450, and the signal-return conductor of line 418 in plane X4 to ground planes 510, 600. However, electrically conductive vias 648, 650 may extend between planes X2, X4, thereby electrically connecting thread conductor 642 with associated signal-return conductors in respective planes X2, X4 but not to either of ground planes 510, 600.

Similarly, transmission line 424 may include another signal-return conductor 658 similar to signal-return conductor 456 but extending along plane X4. Thread conductors 660, 662 may extend along opposing lateral edges of signal conductor 440 and along plane X1. A plurality of electrically conductive vias 664 may extend between planes X3, X5 (e.g., in a manner similar to electrically conductive via 646 depicted in FIG. 5) thereby electrically connecting thread conductors 660, 662 and signal-return conductors 456, 658 to ground planes 510, 600. Similarly, via 586 may extend between planes X3, X5 thereby electrically connecting thread conductor 660 and signal-return conductors 456, 658 to ground planes 510, 600. However, electrically conductive vias 668, 670 may extend between planes X2, X4, thereby electrically connecting thread conductor 662 with associated signal-return conductors in respective planes X2, X4 but not to either of ground planes 510, 600.

Transmission lines 410, 412, 414 may respectively include additional signal-return conductors respectively similar in structure to signal-return conductors 442, 444, 446, but extending along plane X4. As shown, thread conductors may be disposed adjacent opposing lateral sides of respective signal conductors 426, 428, 430, and may be electrically connected to the opposing signal-return conductors of the respective transmission lines and to ground planes 510, 600 by a plurality of electrically conductive vias, for example, in a manner similar to that described above. For example, each of vias 540, 542, 544, 546, 550, 552, 554, 556 may extend between planes X3, X5.

Further, transmission line 420 may include a corresponding signal-return conductor portion similar in structure to portion 454*a*, but extending along plane X4 opposite portion

452*a* (e.g., behind portion 452*a* in FIG. 4). Associated vias 568, 570 may extend between planes X3, X5 thereby electrically connecting ground planes 510, 600 to (a) thread conductors extending along plane X1 adjacent opposing lateral sides of portion 436*a*, (b) portion 452*a*, and (c) the corresponding signal-return conductor portion opposite portion 452*a* and extending along plane X4. Also, transmission line 420 may include another signal-return conductor portion opposite from portion 454*a* similar in structure to portion 452*c* but extending along plane X4, and thread conductors extending along plane X1 adjacent opposing lateral sides of portion 436*c*. A plurality of electrically conductive vias (e.g. including vias 572, 574) may electrically connect these thread conductors and signal-return conductor portions (e.g., surrounding portion 436*c*) to ground planes 510, 600 by extending between planes X3, X5.

Similarly, transmission line 422 may include a signal-return conductor portion similar in structure to portion 452*a*, but extending along plane X4 opposite portion 454*a* (e.g., behind portion 454*a* in FIG. 4). Vias 576, 578 may extend between planes X3, X5 thereby electrically connecting ground planes 510, 600 to (a) thread conductors extending along plane X1 adjacent opposing lateral sides of portion 438*a*, (b) portion 454*a*, and (c) the corresponding signal-return conductor portion opposite portion 454*a* and extending along plane X4. Also, transmission line 422 may include another signal-return conductor portion similar in structure to portion 454*c* but extending along plane X4, and thread conductors extending along plane X1 adjacent opposing lateral sides of portion 438*c*. A plurality of electrically conductive vias (e.g. including vias 580, 582) may electrically connect these thread conductors and signal-return conductor portions (e.g., surrounding portion 438*c*) to ground planes 510, 600 by extending between planes X3, X5. Moreover, a plurality of electrically conductive vias 680 may electrically connect corresponding portions 452*b*, 454*b* to ground planes 510, 600 by extending between planes X3, X5.

Transmission line 416 may include another signal-return conductor portion similar in structure to portion 448*c*, but extending opposite portion 448*c* along plane X4. Via 504 may extend between planes X2, X4 to electrically connect this other signal-return conductor portion to portion 448*c* and end 448*f*. Similarly, electrically conductive vias 700, 702 may extend between planes X2, X4 to respectively electrically connect opposing thread conductors 704, 706 extending along plane X1 adjacent portion 432*c* to these signal-return conductor portions (e.g., surrounding portion 432*c*). However, vias 700, 702 may not extend to either of ground planes 510, 600.

Similarly, transmission line 416 may include another signal conductor portion similar in structure to portion 432*d*, but extending opposite portion 432*d* along plane X4. Via 502 may extend between planes X2, X4 to electrically connect this other signal conductor portion to portion 432*d* and end 432*e*. Similarly, electrically conductive vias 708, 710 may extend between planes X2, X4 to electrically connect thread conductor 712 extending along plane X1 adjacent one lateral edge of portion 448*d* to these signal conductor portions (e.g., extending along one edge of portion 448*d*). However, vias 708, 710 may not extend to either of ground planes 510, 600. Further, another thread conductor 714 may extend along (and/or adjacent) the other lateral edge of portion 448*d* in plane X1. As also shown, a thread conductor 716 may be disposed between (but not connected to either of) ends 432*e*, 448*f* in plane X1. Thread conductor 716 may be electrically floating, being neither connected to portion 448*c*, portion 432*d*, nor ground planes 510, 600.

Figure 6:
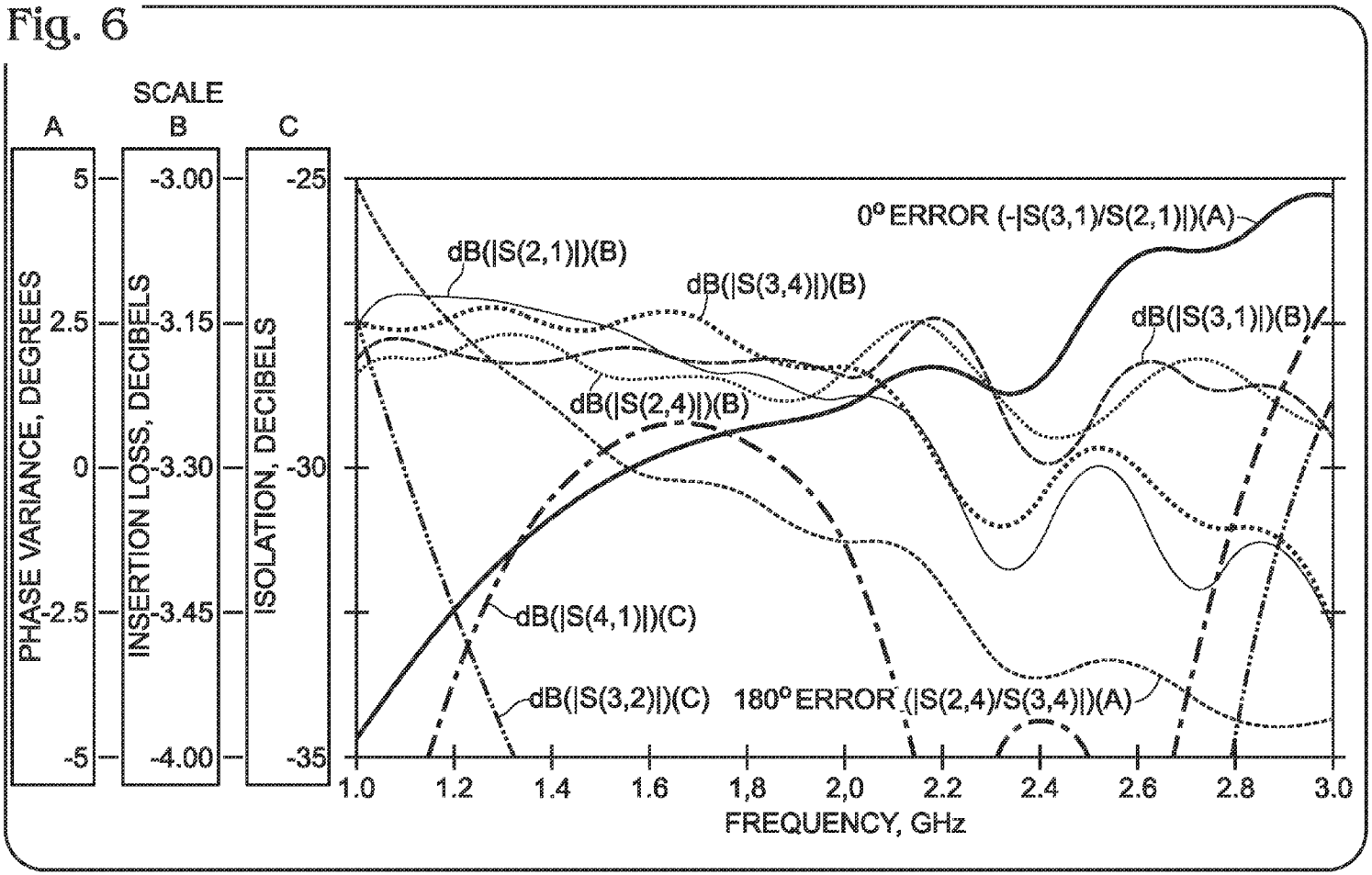
FIG. 6 is a chart illustrating a simulated performance of the planar embodiment of FIG. 4.

Various simulated operating parameters over a frequency range of 1.0 GHz to 3.0 GHz are illustrated in FIG. 6 for coupler 400. In FIG. 6, ports 402, 404, 406, 408 of coupler 400 are identified as 1, 3, 4, and 2, respectively. Three scales for the vertical axis, identified as scales A, B and C, apply to the various curves. Computed phase variance from 0 degrees (shown as the negative of the value for clarity) on ports 404 and 408 for a signal applied to port 402 and phase variance from 180 degrees on ports 404 and 408 for a signal applied to port 406, to which scale A applies, each ranges between about −5 degrees and about +5 degrees with about 0 degree phase variance for each occurring at around 1.56 GHz. Insertion losses, to which scale B applies, are less than −3.10 decibels (dB) over the entire frequency range. Isolation, to which scale C applies, is less than −27 dB over the frequency range shown.

The above descriptions are intended to be illustrative and not restrictive. Many other embodiments will be apparent to those skilled in the art, upon reviewing the above description. The scope of the inventions should therefore be determined with reference to the appended claims, along with the full scope of equivalents to which such claims are entitled. Accordingly, while various embodiments have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure.

An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated. Ordinal indicators may be applied to associated elements in the order in which they are introduced in a given context, and the ordinal indicators for such elements may be different in different contexts.

What is claimed is:

1. A hybrid coupler comprising:

first, second, third, and fourth ports; and first, second, third, fourth, fifth, sixth, seventh, and eighth transmission lines including respective first, second, third, fourth, fifth, sixth, seventh, and eighth signal conductors, and respective first, second, third, fourth, fifth, sixth, seventh, and eighth signal-return conductors closely inductively coupled to the respective signal conductors, each of the signal conductors and signal-return conductors having respective first and second ends;

wherein the first, second, third, and fourth transmission lines are connected together to form a loop with the first, second, and third transmission lines in series, wherein the first end of the first signal conductor is connected to the second end of the second signal conductor at a first junction, the first end of the first signal-return conductor is connected to the second end of the second signal-return conductor at a second junction, the first end of the second signal conductor is connected to the second end of the third signal conductor at a third junction, the first end of the second signal-return conductor is connected to the second end of the third signal-return conductor at a fourth junction, the first end of the third signal conductor is connected to the second end of the fourth signal-return conductor at a fifth junction, the first end of the third signal-return conductor is connected to the second end of the fourth signal conductor at a sixth junction, and the first end of the fourth signal conductor is connected to the second end of the first signal conductor at a seventh junction, the first end of the fourth signal-return conductor is connected to the second end of the first signal-return conductor at an eighth junction;

wherein the fifth, sixth, seventh, and eighth transmission lines respectively connect the loop to the first, second, third, and fourth ports by:

the fifth signal and signal-return conductors connecting the respective seventh and eighth junctions to the first port, the sixth signal and signal-return conductors connecting the respective first and second junctions to the second port, the seventh signal and signal-return conductors connecting the respective third and fourth junctions to the third port, and the eighth signal and signal-return conductors connecting the respective fifth and sixth junctions to the fourth port; and wherein the second and fourth junctions are connected to ground, the sixth and eighth junctions are not directly connected to ground, the first signal-return conductor is connected to ground at a first position disposed between and spaced from the first and second ends of the first signal-return conductor, and the third signal-return conductor is connected to ground at a second position disposed between and spaced from the first and second ends of the third signal-return conductor.

2. The hybrid coupler of claim 1, wherein the fifth signal-return conductor is connected to ground at a third position spaced from the eighth junction.

3. The hybrid coupler of claim 2, wherein the eighth signal-return conductor is connected to ground at a fourth position spaced from the sixth junction.

4. The hybrid coupler of claim 3, wherein the first, second, third, and fourth transmission lines each have an electrical length of $\lambda/4$, where $\lambda$ is a wavelength of an operating frequency of the hybrid coupler, the first signal-return conductor includes a first portion extending from the eighth junction to the first position, the third signal return conductor includes a first portion extending from the sixth junction to the second position, and the first portions of the respective first and third signal-return conductors each have an electrical length of less than $\lambda/4$.

5. The hybrid coupler of claim 4, wherein the first portions of the respective first and third signal-return conductors each have an electrical length of $\lambda/8$.

6. The hybrid coupler of claim 4, wherein the fifth signal-return conductor includes a first portion extending from the eighth junction to the third position, the eighth signal-return conductor includes a first portion extending from the sixth junction to the fourth position, and the first portions of the fifth and eighth signal-return conductors each have an electrical length of less than $\lambda/4$.

7. The hybrid coupler of claim 6, wherein the first portions of the respective fifth and eighth signal-return conductors each have an electrical length of $\lambda/8$.

8. The hybrid coupler of claim 6, wherein the fifth signal-return conductor is directly connected to ground at the third position, and the eighth signal-return conductor is directly connected to ground at the fourth position.

9. The hybrid coupler of claim 1, wherein the first signal-return conductor is directly connected to ground at the first position, and the third signal-return conductor is directly connected to ground at the second position.

10. The hybrid coupler of claim 9, wherein $\lambda$ is a wavelength of an operating frequency of the hybrid coupler, the second junction is directly connected to ground and disposed approximately $\lambda/8$ away from the first position, and the fourth junction is directly connected to ground and disposed approximately $\lambda/8$ away from the second position.

11. The hybrid coupler of claim 1, wherein the first, second, and third transmission lines are respective first, second, and third coaxial transmission lines each including the first, second, and third signal conductors as respective first, second, and third inner conductors and the first, second, and third signal-return conductors as respective first, second, and third outer conductors, the fourth transmission line is a fourth coaxial transmission line including first and second coaxial line portions, the first coaxial line portion including a first outer conductor portion and a first inner conductor portion each having respective first and second ends, the second coaxial line portion including a second outer conductor portion and a second inner conductor portion each having first and second ends, the first inner conductor portion being connected to the second outer conductor portion, the first outer conductor portion being connected to the second inner conductor portion, with the first inner conductor portion and the second outer conductor portion forming the fourth signal conductor, and the first outer conductor portion and the second inner conductor portion forming the fourth signal-return conductor.

12. The hybrid coupler of claim 11, wherein the first and second outer conductor portions and the first and second inner conductor portions each have an electrical length of $\lambda/8$.

13. The hybrid coupler of claim 11, wherein the outer conductor of the first coaxial transmission line is grounded at the first position, the outer conductor of the third coaxial transmission line is grounded at the second position, the fifth, sixth, seventh, and eighth transmission lines are respective fifth, sixth, seventh, and eighth coaxial transmission lines each including an inner conductor and an outer conductor, the outer conductor of the fifth coaxial transmission line being connected to ground at a third position spaced from the eighth junction, and the outer conductor of the eighth coaxial transmission line being connected to ground at a fourth position spaced from the sixth junction.

14. The hybrid coupler of claim 1, wherein the first, second, third, and fourth transmission lines are respective first, second, third, and fourth planar transmission lines at least partially characterized by:

the first, second, and third signal conductors extending along a first plane;

the first, second, and third signal-return conductors extending along at least a second plane parallel to and spaced apart from the first plane;

the fourth signal conductor including a first conductor portion extending along the first plane, and a second conductor portion extending along the second plane, with a first end of the first conductor portion being connected to the seventh junction, a second end of the first conductor portion being connected to a first end of the second conductor portion, and a second end of the second conductor portion being connected to the sixth junction; and the fourth signal-return conductor including a third conductor portion extending along the second plane, and a fourth conductor portion extending along the first plane, a first end of the third conductor portion being connected to the eighth junction, a second end of the third conductor portion being connected to a first end of the fourth conductor portion, and a second end of the fourth conductor portion being connected to the fifth junction.

15. The hybrid coupler of claim 14, wherein λ is a wavelength of an operating frequency of the hybrid coupler, the first and second conductor portions have equal electrical lengths of λ/8, and the third and fourth conductor portions have equal electrical lengths of λ/8.

16. The hybrid coupler of claim 14, further comprising a first dielectric layer disposed between the first and second planes, and first and second electrically conductive vias extending through the first dielectric layer, the second end of the first conductor portion being connected to the first end of second conductor portion by the first electrically conductive via, and the second end of the third conductor portion being connected to the first end of the fourth conductor portion by the second electrically conductive via.

17. The hybrid coupler of claim 16, further comprising a ground plane and a second dielectric layer, the ground plane extending along a third plane parallel to and spaced apart from the first and second planes such that the second plane extends between the first and third planes, the second dielectric layer being disposed between the second and third planes, the first signal-return conductor being electrically connected to the ground plane at the first position, the third signal-return conductor being electrically connected to the ground plane at the second position, and the second and fourth junctions being grounded to the ground plane.

18. The hybrid coupler of claim 17, wherein the fifth, sixth, seventh, and eighth transmission lines are respective fifth, sixth, seventh, and eighth planar transmission lines at least partially characterized by the fifth, sixth, seventh, and eighth signal conductors extending along the first plane, and the fifth, sixth, seventh, and eighth signal-return conductors extending along at least the second plane, the fifth-signal return conductor being electrically connected to the ground plane at a third position spaced from the eighth junction, the eighth signal-return conductor being electrically connected to the ground plane at a fourth position spaced from the sixth junction.

19. The hybrid coupler of claim 18, wherein λ is a wavelength of an operating frequency of the hybrid coupler, the first, second, third, and fourth planar transmission lines each have an electrical length of λ/4, the sixth and seventh planar transmission lines each having an electrical length of λ/8, the first signal-return conductor having an electrical length of λ/8 between the eighth junction and the first position, the third signal-return conductor having an electrical length of λ/8 between the sixth junction and the second position, the third position being spaced λ/8 away from the eighth junction, the fourth position being spaced λ/8 away from the sixth junction, the fifth signal conductor having an electrical length of λ/4 extending between the seventh junction and the first port, and the eighth signal conductor having an electrical length of λ/4 extending between the fifth junction and the fourth port.

* * * * *